US009554681B2

(12) United States Patent
Schultink et al.

(10) Patent No.: US 9,554,681 B2
(45) Date of Patent: Jan. 31, 2017

(54) VACUUM-CLEANING APPARATUS WITH VACUUM-CLEANER UNIT AND FILTER BAG

(75) Inventors: Jan Schultink, Overpelt (BE); Ralf Sauer, Overpelt (BE)

(73) Assignee: Eurofilters Holding N.V., Overpelt (BE)

( * ) Notice: Subject to any disclaimer, the term of this patent is extended or adjusted under 35 U.S.C. 154(b) by 892 days.

(21) Appl. No.: 13/820,705

(22) PCT Filed: Sep. 5, 2011

(86) PCT No.: PCT/EP2011/004464

§ 371 (c)(1),
(2), (4) Date: Apr. 11, 2013

(87) PCT Pub. No.: WO2012/031734

PCT Pub. Date: Mar. 15, 2012

(65) Prior Publication Data

US 2013/0198994 A1 Aug. 8, 2013

(30) Foreign Application Priority Data

Sep. 8, 2010 (EP) ..... 10009351
Sep. 24, 2010 (DE) ..... 10 2010 046 463

(51) Int. Cl.
*A47L 9/10* (2006.01)
*A47L 9/14* (2006.01)

(52) U.S. Cl.
CPC ..... *A47L 9/14* (2013.01); *A47L 9/1454* (2013.01); *Y10T 29/49826* (2015.01)

(58) Field of Classification Search
CPC ..... A47L 9/14; A47L 9/1454; Y10T 29/49826
USPC ..... 15/347, DIG. 8
IPC ..... A47L 9/10
See application file for complete search history.

(56) References Cited

U.S. PATENT DOCUMENTS 4,591,369 A 5/1986 Stewart, Sr. et al.

FOREIGN PATENT DOCUMENTS

| | | | |
|---|---|---|---|
| DE | 199 48 909 | A1 | 4/2001 |
| DE | 20 2005 000917 | U1 | 4/2005 |
| DE | 20 2005 016309 | U1 | 1/2006 |
| DE | 10 2005 049118 | B3 | 2/2007 |
| DE | 10 2007 006502 | A1 | 2/2008 |
| DE | 20 2007 018376 | U1 | 7/2008 |
| DE | 20 2008 016300 | U1 | 4/2009 |
| DE | 10 2007 060748 | A1 | 6/2009 |
| DE | 20 2009 004433 | U1 | 7/2009 |
| DE | 10 2008 006769 | A1 | 8/2009 |
| DE | 10 2008 045683 | A1 | 3/2010 |
| EP | 0 161 790 | A2 | 11/1985 |
| EP | 0 791 322 | A2 | 8/1997 |
| EP | 1 661 500 | A1 | 5/2006 |
| EP | 1 787 560 | A1 | 5/2007 |
| EP | 1 787 563 | A1 | 5/2007 |
| EP | 2 366 321 | A1 | 9/2011 |
| GB | 291 414 | A | 9/1928 |
| JP | S56-132924 | A | 10/1981 |
| JP | S60-139229 | A | 7/1985 |
| JP | 08-126598 | A | 5/1996 |
| JP | 2003-102661 | A | 4/2003 |
| JP | 2005-296531 | A | 10/2005 |
| WO | WO 97/49325 | A1 | 12/1997 |
| WO | WO 00/00269 | A1 | 1/2000 |

OTHER PUBLICATIONS

AEG—Electrolux Ultratone™: Der Eine. Der Perfekte.; Product brochure; downloaded from the internet at URL:http//www.electrolux-ui.com/2009/219/3890-02DE.pdf; 16 pages; Feb. 18, 2009.

*Primary Examiner* — David Redding
(74) *Attorney, Agent, or Firm* — Brinks Gilson & Lione

(57) ABSTRACT

The invention relates to a vacuum-cleaning apparatus with a vacuum-cleaner unit and a filter bag, in which the filter bag is designed as a flat bag, as a nonwoven filter bag and as a disposable filter bag, and the vacuum-cleaner unit has a filter-bag-accommodating chamber with rigid walls, wherein the filter-bag-accommodating chamber has an opening which can be closed by a flap and has a predetermined opening surface area, through which the filter bag can be inserted into the filter-bag-accommodating chamber. The invention is distinguished in that the ratio between the surface area of a rectangle corresponding to the opening surface area and the surface area of the filter bag is greater than 0.70, preferably greater than 0.85, and highly preferably greater than 1.0.

14 Claims, 4 Drawing Sheets

VACUUM-CLEANING APPARATUS WITH VACUUM-CLEANER UNIT AND FILTER BAG

This application claims the benefit under 35 U.S.C. §371 of International Application No. PCT/EP2011/004464, filed Sep. 5, 2011, which claims the benefit of European Patent Application No. 10009351.7, filed Sep. 8, 2010, and German Application No. 10 2010 046 463.5 filed Sep. 24, 2010, which are incorporated by reference herein in their entirety.

FIELD OF THE INVENTION

The present invention refers to a vacuum-cleaning apparatus with a vacuum-cleaner unit and a filter bag, in which the filter bag is designed as a flat bag, as a nonwoven filter bag and as a disposable filter bag, and the vacuum-cleaner unit comprises a filter-bag accommodating chamber with rigid walls, the filter-bag accommodating chamber comprising an opening which can be closed by a flap and has a predetermined opening area, through which the filter bag can be inserted into the filter-bag accommodating chamber. Moreover, the present invention refers to a filter bag and to a method for inserting a filter bag into a filter-bag accommodating chamber of a vacuum-cleaner unit.

PRIOR ART

Filter bags in the form of disposable flat bags made of nonwoven represent the filter bags that are most frequently used nowadays. The advantage of bags made of nonwoven (as compared with filter bags made of paper) is the much higher dust-holding capacity of the filter bag together with a higher collection efficiency and a longer service life. The form of the flat bag is the most common form for nonwoven bags because bags with this form can be produced very easily, for—in contrast to the paper filter material used in filter bags of paper—nonwoven filter material can be permanently folded only with great difficulty because of the high restoration elasticity, so that the manufacture of rather complex bag forms, such as e.g. block-bottom bags or other bag forms with bottom, is very troublesome and expensive.

A flat bag in the sense of the present invention encompasses filter bags which are formed from two individual layers of filter material with an identical area in such a manner that the two individual layers are only interconnected on their peripheral edges (of course the expression identical area does not rule out the possibility that the two individual layers differ from each other such that one of the layers includes an inlet opening).

The individual layers are joined by way of a weld or adhesive seam along the whole periphery of the two individual layers; however, said joint may also be formed in that an individual layer of filter material is folded around one of its axes of symmetry and the remaining open peripheral edges of the two sub-layers created thereby are welded or glued (so-called tubular bag).

An individual layer of filter material taken as such may here also consist of one or plural layers which may e.g. be laminated. An individual layer may also be formed from folded filter material.

Flat bags in the sense of the present invention may also comprise so-called side folds. Said side folds can here be fully folded out. A flat bag with such side folds is e.g. shown in DE 20 2005 000 917 U1 (see FIG. 1 with folded-in side folds and FIG. 3 with folded-out side folds). Alternatively, the side folds may also be welded with parts of the peripheral edge. Such a flat bag is shown in DE 10 2008 006 769 A1 (see particularly FIG. 1 thereof).

It automatically follows from the above definition of the term flat bag that flat bags are two-dimensional structures directly after manufacture; hence, before use they have an inner volume which is substantially equal to zero.

A filter bag with an inner volume which (before use) is substantially equal to zero is however not necessarily a flat bag in the sense of the present invention. The reason is that bag forms which have a bottom, as e.g. shown in DE 20 2005 016 309 U1 or DE 20 2009 004 433 U1, are not flat bags because they do not consist of two individual layers with an identical area that are only interconnected on their peripheral edges.

In view of the above definitions it goes without saying that bag forms which after manufacture are already three-dimensional structures and thus have an inner volume differing from zero, as are e.g. shown in WO 00/00269 (see FIGS. 27 and 28 thereof) and in DE 10 2007 060 748 (see particularly FIG. 9 thereof) are not flat bags in the sense of the present invention.

A nonwoven filter bag in the sense of the present invention comprises a filter material of nonwoven. A dry-laid or a wet-laid nonwoven or an extrusion nonwoven, particularly a meltspun microfiber spunbonded nonwoven (meltblown nonwoven) or spunbonded nonwoven from filaments (spunbond) can be used as the nonwoven material. Nanofiber layers may also be present in addition. The distinction between wet-laid nonwovens and conventional wet-laid paper is in conformity with the definition given below, as is also used by the EDANA (International Association Serving the Non-wovens and Related Industries). A conventional (filter) paper is thus not a nonwoven.

The nonwoven may comprise staple fibers or continuous fibers. From a manufacturing point of view it is also possible to provide plural layers of staple fibers or continuous fibers that are consolidated to exactly one layer of nonwoven.

The filter material may also be a laminate consisting of plural nonwoven layers, such as e.g. spundbonded nonwoven from filaments and meltblown nonwoven (SMS, SMMS or SnxMs). Such a laminate can be laminated or calendered by means of a hot-melt adhesive. The layer of meltblown nonwoven may be creped.

The term "nonwoven" is used according to the definition given in the ISO standard ISO 9092: 1988 or in the EN 29092 standard. Especially the terms fiber web or web and nonwoven are distinguished from one another in the manufacture of nonwovens in the following manner and have also to be understood in this manner in the sense of the present invention. Fibers and/or filaments are used for making a nonwoven. The fluffy or loose and still unbonded fibers and/or filaments are called web or fiber web. A nonwoven which exhibits sufficient strength to be e.g. wound onto rolls is finally created by way of a so-called web bonding step from such a fiber web. In other words a nonwoven is made self-supporting by way of consolidation. (Details on the use of the definitions and/or methods as described herein can also be gathered from the standard work "Vliesstoffe", W. Albrecht, H. Fuchs, W. Kittelmann, Wiley-VCH, 2000).

The non-woven material may be present as a non-folded layer for a filter bag in the sense of the present invention or, in turn, it may comprise surface folds. It follows e.g. from European patent application 10163463.2 how such surface folds can be designed.

The size of flat bags as are known from the prior art and are made of nonwoven depends on the respective application. A frequently used size of such filter bags for domestic vacuum cleaners shows a length and a width of about 30 cm each and a height of about 1 cm. A conventional vacuum-cleaner unit, particularly a conventional floor vacuum-cleaner unit in which filter bags of the aforementioned size are used, comprises a filter-bag accommodating chamber having a length, width and height each in the range between 10 cm and 20 cm.

The filter-bag accommodating chamber according to the present invention is formed from rigid walls. To this end the filter-bag accommodating chamber may be provided as an integral part of the housing or as a partial housing of the vacuum-cleaner unit. Filter-bag accommodating chambers which consist of a firm fabric, as are e.g. known from the prior art in the case of hand-held vacuum-cleaner units (see e.g. EP 0 161 790), are without rigid walls in the sense of the invention.

Now if one inserts a conventional filter bag into a conventional vacuum-cleaner unit, the above-mentioned size ratios of filter bag and filter-bag accommodating chamber of the vacuum-cleaner unit have the effect that the filter bag cannot be placed into the filter-bag accommodating chamber in a fully unfolded state, but (apart from the two superimposed individual layers) various portions of the superimposed individual layers are also rather overlapping or portions of one or of both of the individual layers overlap themselves. Moreover, the size ratios have the effect that the filter bag can also not fully unfold during operation of the vacuum cleaning apparatus. This effect is additionally enhanced in that the filter bags are inserted into the filter-bag accommodating chamber in the folded state. (If one packed e.g. five of the above-mentioned filter bags without folding the same, this would yield a package with a size of about 30 cm×30 cm×5 cm. Since such a packing size is entirely unsuited for the sale of filter bags, filter bags are always folded before being placed into a package suited for sale. For insertion into the filter-bag accommodating chamber the filter bags are then just taken out from the package and inserted in the folded state into the vacuum-cleaner unit.)

This overlap of filter area in the case of conventional filter bags in conventional vacuum-cleaner units leads to an irregular exploitation and filling of the filter bag during suction operation. The properties inherent to the filter bag, such as dust holding capacity, collection efficiency and service life, are thus not exploited in an optimum manner.

In view of these drawbacks of the prior art it is the object of the present invention to provide a combination between vacuum-cleaner unit and filter bag that better exploits the properties inherent to the filter bag, such as e.g. dust holding capacity, collection efficiency and service life.

BRIEF DESCRIPTION OF THE INVENTION

The above-mentioned object is achieved by a vacuum cleaning apparatus of the aforementioned type that is distinguished in that the ratio between the area of a rectangle corresponding to the opening area and the area of the filter bag is greater than 0.70, preferably greater than 0.85, and highly preferably greater than 1.0.

The area of the rectangle corresponding to the opening area is determined within the scope of the present invention with the help of the so-called minimal bounding rectangle which is well known from image processing (see e.g. in Tamara Ostwald, "Objekt-Identifikation anhand Regionen beschreibender Merkmale in hierarchisch partionierten Bildern", Aachener Schriften zur medizinischen Informatik, Vol. 04, 2005).

For the determination of the area of the rectangle one must make a distinction whether the opening area is positioned within a plane (two-dimensional opening area with two-dimensional edge) or whether the opening area extends beyond a plane (three-dimensional opening area with three-dimensional edge).

In the case of a two-dimensional opening area the area of the rectangle conforming to the opening area is directly determined by way of the area of the minimal rectangle bounding the two-dimensional edge of the opening area.

In the case of a three-dimensional area, the three-dimensional edge must first be transformed into a two-dimensional edge before the area of the rectangle can be determined with a bounding rectangle. To this end the edge is divided into N identical portions. Owing to this division, N points $P_n$ ($n=1, \ldots, N$) are determined on the three-dimensional edge. Then the centroid SP of this three-dimensional edge is determined and the distance $d_n$ of each one of the N points $P_n$ from the centroid SP is determined. This will then yield a point set in polar coordinates $K_n$ ($d_n$; ($360 \times n/N$)°). If one lets N get very large, this point set turns into a two-dimensional edge corresponding to the three-dimensional edge, for which a bounding rectangle can be determined. N=360 is set for the transformation according to the present invention.

The area of the rectangle, which rectangle corresponds to the opening area, represents a good and definite approximation of the opening area of the vacuum-cleaner unit which even in the case of complex opening areas and opening edges can be determined in a simple manner.

The area of a filter bag in the sense of the present invention is determined on the filter bag if in the completely unfolded form it lies flat, i.e. in a two-dimensional form, on a substrate. In the case of a filter bag with non-welded side folds the side folds are completely unfolded for determining the area. By contrast, if the filter bag comprises welded side folds, these will not be taken into account in the determination of the area. For instance, the area of a filter bag with rectangular form is obtained in that the filter bag is taken out of its package and completely unfolded and its length and width are measured and these are multiplied by each other.

If the opening area with regard to the area of the filter bag satisfies this relation, it will then be ensured that the filter bag can be introduced in a substantially completely folded-out state into the filter-bag accommodating chamber. An overlap of the two individual layers or an overlap of one of the two individual layers with itself is thus avoided. The major part of the whole filter area of the filter bag is available right from the beginning of the suction operation (for this filter bag) and the filtering properties of the filter bag, particularly the dust holding capacity which can be achieved for the filter bag together with a high collection efficiency and a long service life, are thus optimally exploited right from the start.

The object underlying the invention is also achieved by an apparatus of the aforementioned type in which the ratio of the holding volume of the filter bag in the filter-bag accommodating chamber to the maximum holding volume of the filter bag is greater than 0.70, preferably greater than 0.75, highly preferably greater than 0.8.

The holding volume of the filter bag in the filter-bag accommodating chamber is determined according to the present invention according to EN 60312, Chapter 2.7.

The maximum holding volume of the filter bag is determined according to the present invention by analogy with EN 60312, Chapter 2.7. The only difference with respect to EN 60312, Chapter 2.7, is here that the filter bag is provided freely suspended in a chamber having a volume which is at least so great that the filter bag is not prevented from completely expanding to its maximally possible size in the case of a full filling. For instance, a cube-shaped chamber with an edge length equal to the square root of the sum of the squares of maximum length and maximum width of the filter bag satisfies this requirement.

If the filter-bag accommodating chamber is configured such that the filter bag intended for it satisfies the above-conditions, it is ensured that during the whole suction operation (until the exchange of the bag) the major part of the whole filter area of the filter bag is available and the filter bag is thus optimally filled during operation. The filtering properties of the filter bag, particularly the dust holding capacity which can be achieved for the filter bag together with a high collection efficiency and a long service life, are thus optimally exploited until the exchange of the filter bag.

According to a preferred development the two above-discussed solutions can also be combined with one another. The advantages mentioned for both solutions are thereby equally implemented.

Moreover, according to a preferred development of both of the above-described solutions, the ratio between surface of the filter-bag accommodating chamber and the surface of the filter bag is greater than 0.90, preferably greater than 0.95, highly preferably greater than 1.0.

The surface of the filter bag in the sense of the present invention is here defined to be twice the area occupied by the filter bag if in a completely unfolded form it lies flat, i.e. in a two-dimensional form, on a substrate. The area of the inlet opening and the area of the weld seams are not taken into account because they are relatively small in comparison with the real filter area. Likewise, possible folds provided in the filter material itself (for surface increase of the filter material) are left out of consideration. The surface of a rectangular filter bag (according to the above definition) is thus simply obtained in that it is taken out of its package, completely unfolded, its length and width are measured, these are multiplied by each other and the result is multiplied by two.

The surface of the filter-bag accommodating chamber in the sense of the present invention is defined as the surface which the filter-bag accommodating chamber would have if (as far as present) all means (ribs, rib-shaped sections, bows, etc.) provided in the filter-bag accommodating chamber for the purpose that the filter material of the filter bag remains spaced apart from the wall of the filter-bag accommodating chamber (which is required in the case of a smooth filter material to ensure that air can flow through the filter bag at all) were left out of consideration. The surface of a cuboid filter-bag accommodating chamber with ribs is thus obtained as the maximum length multiplied by the maximum width multiplied by the maximum height of the filter-bag accommodating chamber without the dimensions of the ribs being here taken into account.

Since the surface of the filter-bag accommodating chamber is just included as the lower limit in the above relation, it is possible for the determination as to whether a specific vacuum-cleaner unit in combination with the filter bag makes use of the previously discussed development, especially if the filter-bag accommodating chamber is of a complicated geometrical shape, to alternatively determine the surface of a cuboid body which fully encloses the filter-bag accommodating chamber; the surface of such a body is e.g. obtained when one determines the surface of a cuboid with the edge lengths corresponding to the maximum extension of the real filter-bag accommodating chamber in length, width and height direction (length, width and height direction are here of course orthogonal to one another).

If filter-bag accommodating chamber and the filter bag intended for the chamber are designed such that the above-mentioned condition is satisfied, the two are then matched to each other in a particularly advantageous manner, so that the filtering properties of the filter bag, particularly the dust holding capacity which is achievable for the filter bag together with a high collection efficiency and high service life, can be exploited in an optimum way.

According to a preferred development of the present invention the filter-bag accommodating chamber can substantially be formed of two curved areas. Alternatively, the filter-bag accommodating chamber may also be formed of two curved areas and a side area, the side area interconnecting the two curved areas along the periphery of the curved areas. This development takes into account the fact that filter bags in the form of flat bags that have a substantially rectangular shape are expanding upon free filling (i.e. upon a filling in the case of which the filter bag is not restricted in its expansion by a filter-bag accommodating chamber) in such a manner that they assume the shape of a cushion. The two described alternatives represent an optimal adaptation of the filter-bag accommodating chamber to the filter bag. On the other hand, until the complete filling of the filter bag, conditions are always prevailing such that the dust holding capacity which can be achieved for the filter bag together with a high collection efficiency and a long service life are not negatively affected. On the other hand, one can thereby meet the requirement that the dust-filter accommodating chamber can be configured to be as small as possible to keep the overall dimensions of the vacuum-cleaner unit as small as possible.

According to a further preferred development of the invention and all of the above-described developments the flat bag may also be rhombic. Particularly in connection with a filter-bag accommodating chamber comprising two curved areas (with or also without side area) it is possible to achieve a greater flexibility with respect to the width of the vacuum-cleaner unit. For instance, a vacuum-cleaner unit in which rhombic filter bags are used can be configured with a smaller width than a vacuum-cleaner unit in which rectangular bags are used accordingly (identical filling volume). Such a rhombic filter bag has substantially the same filling characteristic as a rectangular bag, i.e., as described in the previous paragraph. Moreover, rhombic filter bags and rectangular filter bags with the same surface can be produced with the same amount of filter material.

A rhombic form with opposite angles in the range of 100° to 120° is here particularly advantageous with respect to the filling characteristic. If these angles are e.g. 105°, one will obtain a rhombic form with the angles 105°-75°-105°-75°.

According to a preferred development of the present invention, including all of the previously described developments, the vacuum-cleaner unit may be a floor vacuum cleaner. Floor vacuum cleaners in the sense of the present invention are vacuum-cleaner units in the case of which filter-bag accommodating chamber and vacuum cleaner motor are provided in a housing (which may also consist of two interconnected sub-housings), which has connected thereto a hose and/or tube (to which a dust collecting means, such as a floor nozzle, a suction brush, a dusting brush or the like are connected), and in the case of which said housing is provided on rolls, so that during suction operation only the hose and/or the tube and the corresponding dust collecting means have to be moved in the first place and the much heavier housing only in the second place. Since in the case of such floor vacuum-cleaner units the weight of the components to be moved is minimized, such floor vacuum-cleaner units can be operated with minimal efforts and are thus in the domestic sector the most common devices in which the present invention can advantageously be used. Furthermore, the invention can also be employed in a hand-held vacuum cleaner in an advantageous way.

According to another advantageous development the surface of the filter-bag accommodating chamber may comprise ribs and/or rib-shaped sections and/or bows, the filter bag may consist of a filter material with fold-like surface, and the height of the ribs and/or of the rib-shaped sections and/or the bows is greater than the maximum folding height of the fold-like surface. Owing to this development the filter-bag accommodating chamber is adapted to filter bags with surface folds, as are e.g. known from European patent application 10163463.2, in such a manner that the surface folds can be fully unfolded and air thereby flows against the maximally available filter area during suction operation.

According to a development which is an alternative to the one described in the previous paragraph, the surface of the filter-bag accommodating chamber is made substantially smooth, and the surface of the filter bag is profiled such that in the state in which the filter bag is inserted into the vacuum-cleaner unit the largest part of the surface of the filter bag remains at a distance from the surface of the filter-bag accommodating chamber. Owing to this development the filter-bag accommodating chamber can be produced in a very simple manner. Waste produced during the manufacture of the vacuum-cleaner units because of defective ribs, rib-shaped sections and bows is thereby avoided.

Advantageously, in the development described in the previous paragraph, filter bags can be used in the case of which the profiling comprises folds. During operation just the tips of the folds will contact the walls of the filter-bag accommodating chamber.

According to another development of the present invention a perforated wall is provided in front of at least a part of the wall of the filter-bag accommodating chamber at a predetermined distance from the wall. With such a perforated wall it is possible to achieve the same effect as with ribs, rib-shaped sections and bows. The provision of such a perforated wall simplifies the constructional efforts in comparison with ribs, rib-shaped sections and bows.

When the filter-bag accommodating chamber is formed by two curved areas (with or without side wall), a perforated wall may be provided at a predetermined distance advantageously in front of at least one of the curved areas, preferably the curved area forming the bottom of the filter-bag accommodating chamber.

Furthermore, according to the present invention a filter bag is provided that can be used in a preferred manner in connection with the present invention.

This filter bag is a flat bag which is made from nonwoven and which is substantially rectangular or substantially rhombic and comprises an inlet opening, such that the centroid of the area of the inlet opening has a shortest distance $D_{EÖ}$ from one of the four corners of the filter bag and the centroid of the area of the filter bag has a shortest distance $D_{FB}$ to the same corner of the filter bag, and $D_{EÖ}$ and $D_{FB}$ satisfy the following relation:

$$D_{EÖ} < \tfrac{2}{3} D_{FB},$$

preferably $D_{EÖ} < \tfrac{1}{2} D_{FB}$ and highly preferably $D_{EÖ} < \tfrac{1}{4} D_{FB}$.

By analogy with the determination of the surface, one starts—for the determination of the centroid of the area of the filter bag—from the area the filter bag assumes if it lies flat on a substrate, i.e., it is present as a two-dimensional structure. When the filter bag comprises unwelded side folds, these are folded out for determining the centroid. By analogy with the determination of the area of the filter bag, welded side folds are left out of consideration.

In the case of the rhombic filter bag it has been found that filter bags with opposite angles in a range of 100° to 120° show a particularly advantageous fill characteristic.

In such a filter bag the inlet opening is provided in one of the four corners of the filter bag (in comparison with the rectangular flat bags known from the prior art, in the case of which the inlet opening is normally provided exactly in or near the central axis of the filter bag).

Hence, this yields particularly advantageous flow conditions in the filter bag, as can otherwise only be achieved by way of additional means, so-called deflection means, as are e.g. known from EP 1 787 560 A1 or EP 1 787 563 A1. These advantageous flow conditions allow a uniform filling of the filter bag. The provision of an additional deflection means as in the previously mentioned prior art is thus not necessary, which simplifies the production of the filter bag.

Moreover, such filter bags can also be used in vacuum-cleaner units in the case of which the filter-bag accommodating chamber is not adapted according to the invention to the bag. Even in such a case the flow conditions can be improved in comparison with a rectangular filter bag in the form of a flat bag, without the need for additional measures, such as deflection means.

According to a preferred development of the previously described filter bag, said bag comprises a retaining plate which has arranged thereon a closure for the filter bag in the form of a flap which is open in the presence of the suction flow and closed in the absence of the suction flow. Expediently, the closure is fastened with a hinge to the retaining plate and the hinge is provided towards the corner of the filter bag. Apart from the advantages, which are known from the prior art, of a self-opening and self-closing flap closure which is fastened to a retaining plate by means of a hinge (namely that the filter bag remains closed in the inoperative state and that such a design can be produced in a particularly simple manner, e.g. by way of an injection molding technique), an optimum distribution of the air flow in the filter bag is achieved according to the invention, i.e. by the measure that the hinge is oriented towards the corner of the filter bag.

Moreover, the invention provides a method for inserting a filter bag into a filter-bag accommodating chamber.

BRIEF DESCRIPTION OF THE FIGURES

In the figures.

DESCRIPTION OF THE PREFERRED EMBODIMENTS OF THE INVENTION

Figure 1:
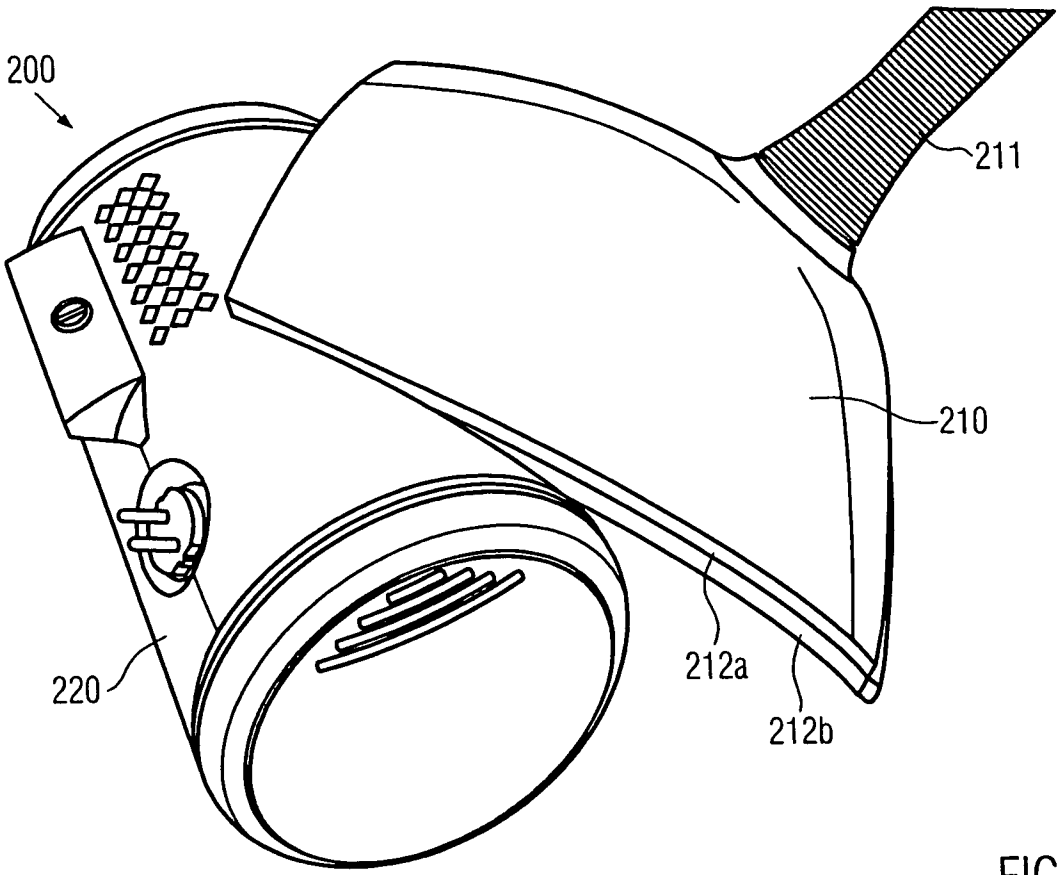
FIG. 1 is an inclined view of a first embodiment of the vacuum cleaning apparatus according to the present invention, in which the filter-bag accommodating chamber is closed.
Figure 2:
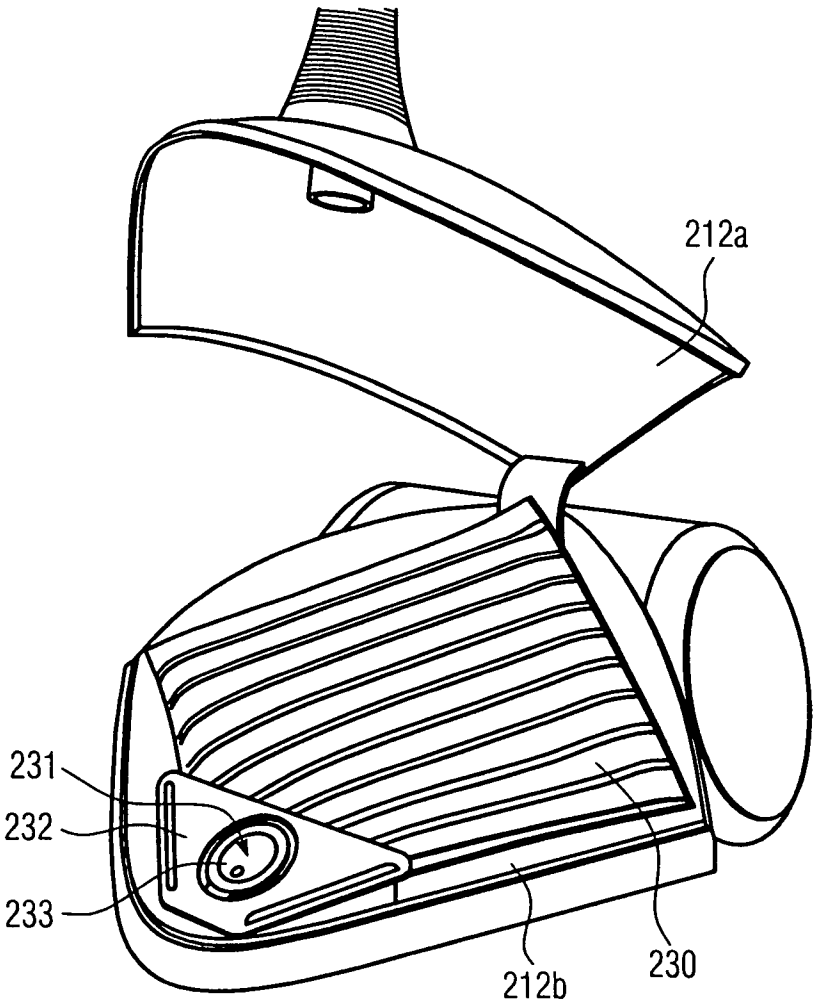
FIG. 2 is an inclined view of the embodiment shown in FIG. 1, in which the filter-bag accommodating chamber is opened, so that the inserted filter bag is visible.

FIGS. 1 and 2 show a first embodiment of a vacuum cleaning apparatus according to the present invention, wherein the filter-bag accommodating chamber is closed in FIG. 1 and the filter-bag accommodating chamber is open in FIG. 2. The filter bag is visible in FIG. 2.

The vacuum-cleaner unit shown in FIG. 1 is a floor vacuum cleaner which has a housing consisting of a first part 210 and of a second part 220 connected to the first part. The first part 210 represents the filter-bag accommodating chamber. The motor of the vacuum-cleaner unit is housed in the second part 220. A hose 211 is connected to the first part 210. As can be seen in FIG. 1 and particularly also in FIG. 2, the filter-bag accommodating chamber is formed of a first curved area 212*a* and a second curved area 212*b*.

Moreover, a filter bag 230 can be seen in FIG. 2. This filter bag has the inlet opening 231 provided in one of its corners. The distance $D_{EÖ}$ of the centroid of the inlet opening from the corner is about ¼ of the distance $D_{FB}$ of the centroid of the filter bag from the corner in the illustrated configuration. A particularly good flow distribution is thereby achieved.

Furthermore, a flap 233 which is self-opening due to the suction flow and self-closing upon stop of the suction flow is provided in front of the inlet opening 231. Said flap is provided on a retaining plate 232 by means of which the filter bag is fixed in the filter-bag accommodating chamber.

In FIG. 2, a filter bag with dovetailed surface folds is inserted into the filter-bag accommodating chamber.

The following table lists the ratio between the area of the rectangle $F_{RE}$ corresponding to the opening area and the filter area $F_{Filter}$, the ratio of the holding volume of the filter bag in the accommodating chamber $V_{AR}$ to its maximum holding volume $V_{Ma}$x and the ratio between surface of the filter-bag accommodating chamber $S_{AR}$ and the surface of the filter bag $S_{Filter}$ for the embodiment shown in FIGS. 1 and 2 according to the invention and for a vacuum cleaning apparatus which is representative of the prior art. The prior-art apparatus is the vacuum-cleaner unit UltraOne ECO of AEG/Elektrolux with the accompanying vacuum cleaner bag S-Bag Ultra Long Performance.

| | $F_{RE}/F_{Filter}$ | $V_{AR}/V_{Max}$ | $S_{AR}/S_{Filter}$ |
|---|---|---|---|
| Prior art | 0.46 | 0.59 | 0.69 |
| Invention | 1.10 | 0.81 | 1.05 |

Figure 3:
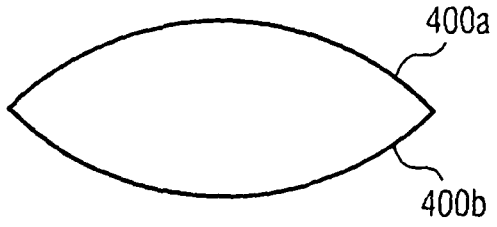
FIG. 3 is a cross-sectional view of the filter-bag accommodating chamber of a second embodiment of the vacuum cleaning apparatus according to the present invention.

FIG. 3 shows a cross section through the filter-bag accommodating chamber of a second embodiment of the present invention. The cross section extends here through the center of the filter-bag accommodating chamber along a first direction. Along a second direction orthogonal to the first direction the cross-section resembles the one shown in FIG. 3. According to this embodiment the filter-bag accommodating chamber consists of two curved areas 400*a* and 400*b*.

Figure 4:
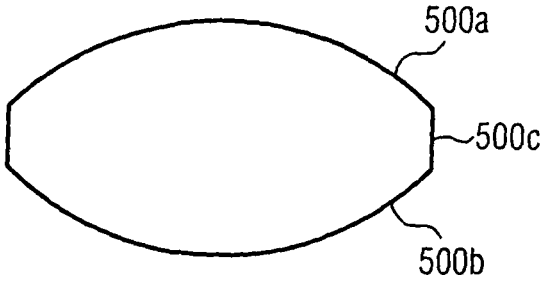
FIG. 4 is a cross-sectional view of the filter-bag accommodating chamber of a third embodiment of the vacuum cleaning apparatus according to the present invention.

FIG. 4 shows a cross-section through the filter-bag accommodating chamber of a third embodiment of the present invention. According to this embodiment the filter-bag accommodating chamber comprises, apart from two curved areas 500*a* and 500*b*, a side area 500*c* which interconnects the two curved areas on their periphery.

The embodiments depicted in FIGS. 3 and 4 represent an optimal adaption of the filter-bag accommodating chamber to the filter bag which in an optimally filled condition assumes the shape of a cushion. On the one hand, until the complete filling of the filter bag, conditions are always prevailing such that the dust holding capacity which is achievable for the filter bag together with a high collection efficiency and a long service life is not negatively affected. On the other hand, the requirement can thereby be taken into account that the dust-filter accommodating chamber should be designed as small as possible to keep the overall dimensions of the vacuum-cleaner unit as small as possible.

Figure 5:
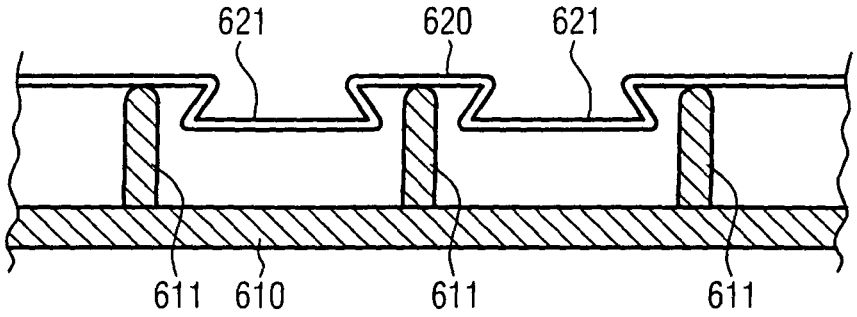
FIG. 5 is a cross-sectional view of a cutout of a wall of the filter-bag accommodating chamber with inserted filter bag according to a fourth embodiment of the vacuum cleaning apparatus according to the present invention.

FIG. 5 is a cross-sectional view of a cutout of a wall of the filter-bag accommodating chamber 610 with inserted filter bag 620 according to a fourth embodiment of the vacuum cleaning apparatus according to the present invention. In this embodiment the wall 610 comprises ribs 611. The filter bag 620 comprises so-called dovetailed folds 621. The maximum folding height of the dovetailed folds 621 (i.e. the height when these are completely folded out) is smaller than the height of the ribs 611. The effective filter area can thereby be increased considerably. A highly efficient combination of vacuum-cleaner unit and filter bag can thereby be accomplished.

Figure 6:
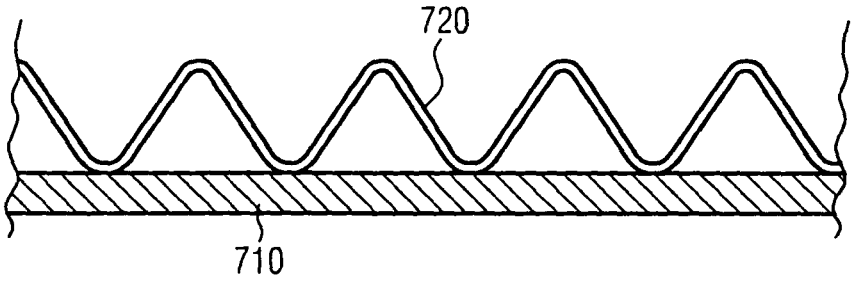
FIG. 6 is a cross-sectional view of a cutout of a wall of the filter-bag accommodating chamber with inserted filter bag according to a fifth embodiment of the vacuum cleaning apparatus according to the present invention.

FIG. 6 is a cross-sectional view of a cutout of a wall of the filter-bag accommodating chamber 710 with inserted filter bag 720 according to a fifth embodiment of the vacuum cleaning apparatus according to the present invention. The surface of the wall of the filter-bag accommodating chamber 710 is made smooth. The surface of the filter bag 720 is profiled by means of standing folds in such a manner that the largest part of the surface of the filter bag remains at a distance from the surface of the filter-bag accommodating chamber. In this embodiment the effective surface of the filter material can also be increased, which also represents a highly efficient combination of vacuum-cleaner unit and filter bag.

The invention claimed is:

1. A vacuum-cleaning apparatus with a vacuum-cleaner unit and a filter bag, the filter bag comprising a flat bag, a nonwoven filter bag and a disposable filter bag, the vacuum-cleaner unit comprising a filter-bag accommodating chamber with rigid walls, the filter-bag accommodating chamber comprising an opening which can be closed by a flap and has a predetermined opening area, through which the filter bag can be inserted into the filter-bag accommodating chamber, the vacuum-cleaning apparatus comprising a ratio between an area of a rectangle corresponding to the opening area and an area of the filter bag wherein the ratio is greater than 0.70, and wherein a ratio between a surface of the filter-bag accommodating chamber and a surface of the filter bag is greater than 0.90.

2. A vacuum-cleaning apparatus with a vacuum-cleaner unit and a filter bag, the filter bag comprising a flat bag, a nonwoven filter bag and a disposable filter bag, the vacuum-cleaner unit comprising a filter-bag accommodating chamber with rigid walls, the filter-bag accommodating chamber comprising an opening which can be closed by a flap and has a predetermined opening area, through which the filter bag can be inserted into the filter-bag accommodating chamber, the vacuum-cleaning apparatus comprising a ratio of a holding volume of the filter bag in the filter bag accommodating chamber to a maximum holding volume of the filter bag, wherein the ratio is greater than 0.70, and wherein a ratio between a surface of the filter-bag accommodating chamber and a surface of the filter bag is greater than 0.90.

3. The apparatus according to claim 1, wherein the filter-bag accommodating chamber is substantially formed of two curved areas.

4. The apparatus according to claim 1, wherein the filter-bag accommodating chamber comprises two curved areas and a side area, wherein the side area connects the two curved areas along a periphery of the curved areas.

5. The apparatus according to claim 1, wherein the flat bag is rhombic.

6. The apparatus according to claim 5, wherein the rhombic form has two opposite angles in a range of 100° to 120°.

7. The apparatus according to claim 1, wherein the vacuum-cleaner unit is a floor vacuum cleaner or a hand-held vacuum cleaner.

8. The apparatus according to claim 1, wherein a surface of the filter-bag accommodating chamber comprises ribs or rib-shaped sections or bows and the filter bag consists of a filter material with fold-like surface, wherein a height of the ribs or of the rib-shaped sections or the bows is greater than a maximum folding height of the fold-like surface.

9. The apparatus according to claim 1, wherein a surface of the filter-bag accommodating chamber is made substantially smooth and a surface of the filter bag is profiled such that when the filter bag is inserted into the vacuum-cleaner unit a largest part of the surface of the filter bag remains at a distance from the surface of the filter-bag accommodating chamber.

10. The apparatus according to claim 9, wherein the filter bag comprises folds.

11. The apparatus according to claim 1, wherein in front of at least a part of a wall of the filter-bag accommodating chamber, a perforated wall is provided at a predetermined distance from the wall of the filter-bag accommodating chamber.

12. The apparatus according to claim 11, wherein the filter-bag accommodating chamber comprises two curved areas and in front of at least one of the curved areas, a perforated wall is provided at a predetermined distance.

13. A method for inserting a filter bag, as the filter bag comprising a flat bag, a nonwoven filter bag and a disposable filter bag, the method comprising inserting the filter bag into the filter-bag accommodating chamber of a vacuum-cleaner unit, the filter-bag accommodating chamber having rigid walls, and the filter-bag accommodating chamber comprising an opening which can be closed by a flap and has a predetermined opening area, through which the filter bag can be inserted into the filter-bag accommodating chamber, such that the filter bag is inserted in a completely unfolded form as a two-dimensional structure into the filter-bag accommodating chamber.

14. The apparatus according to claim 1, wherein the ratio is greater than 1.

* * * * *